United States Patent [19]

Headley

[11] Patent Number: 4,916,594

[45] Date of Patent: Apr. 10, 1990

[54] CIRCUIT-PROTECTED PORTABLE POWER PACK

[76] Inventor: Robert W. Headley, 11020 Walpole Rd., Crooksville, Ohio 43731

[21] Appl. No.: 292,016

[22] Filed: Dec. 30, 1988

[51] Int. Cl.[4] ..... F21L 15/14

[52] U.S. Cl. ..... 362/108; 362/106; 362/183; 307/150

[58] Field of Search ..... 362/105, 9, 10, 103, 362/108, 109, 183, 191, 382, 391, 106; 307/150

[56] References Cited

U.S. PATENT DOCUMENTS

| | | | |
|---|---|---|---|
| 1,723,147 | 3/1927 | Fourethier | 224/902 |
| 2,275,765 | 8/1939 | Hummert et al. | 362/108 |
| 2,724,769 | 4/1953 | D'Arbeloff | 362/108 |
| 4,207,606 | 6/1980 | Gulliksen et al. | 362/106 |
| 4,231,079 | 10/1980 | Heminover | 362/108 |
| 4,328,533 | 5/1982 | Paredes | 362/108 |
| 4,748,344 | 5/1988 | Sing | 307/150 |

*Primary Examiner*—Stephen F. Husar
*Attorney, Agent, or Firm*—Watkins, Dunbar & Pollick

[57] ABSTRACT

One or more circuit-breakers (20 and 32) are installed into power pack circuitry 10 to prevent fire and destruction of the power supply 12 and circuits as a result of shorted components. One or more additional circuits 30 allow simultaneous use of more than one device or provide for a backup device should the first circuit fail. The circuit-breaker (20 or 32) permits quick recovery of the circuitry in dangerous situations such as mining or hunting activities. Batteries 12 of a power supply are attached to a specially designed adjustable belt 40 that allows the weight of the power supply to be positioned over the hips of a user thereby reducing back strain and discomfort. The weight of the power pack is further distributed over the user's body by means of a shoulder harness 70.

26 Claims, 2 Drawing Sheets

CIRCUIT-PROTECTED PORTABLE POWER PACK

FIELD OF THE INVENTION

This invention relates generally to a circuit-protected portable power supply and in particular to a circuit-breaker protected power supply that is supported on a belt and harness worn by a user.

BACKGROUND OF THE INVENTION

The prior art, as exemplified by U.S. Pat. No. 1,723,147 to Fourethier, Aug. 6, 1929; U.S. Pat. No. 2,275,765 to Hummert et al., Mar. 10, 1942; U.S. Pat. No. 2,724,769 to D'Arbeloff, Nov. 22, 1955; U.S. Pat. No. 4,231,079 to Heminover, Oct. 28, 1980; and U.S. Pat. No. 4,328,533 to Paredes, May 4, 1982 is generally illustrative of the pertinent art. None of the devices shown in the prior art protects the circuitry and appliances from burn out as a result of short circuits and other circuitry failure. Such burnout can be extremely costly when the power pack, connecting cables, and appliances are sophisticated or of a heavy duty nature. Although some effort has been made in the past to use fuses in such circuitry, this has proven to be unsatisfactory in unsafe circumstances where the user may not have the time or be able to change such a fuse. For example, it is especially inconvenient to attempt to change a fuse in total darkness such as might be encountered in mining operations or night sporting activities such as racoon hunting.

Another disadvantage with the prior art is that the power pack is often worn about the waist and suspended at the center of the back. Such positioning can be especially troublesome to persons with lower back problems. Moreover, it is almost impossible to wear such a back centered power pack in an automobile or truck.

SUMMARY OF THE INVENTION

The present invention solves these problems by providing a power pack with circuit-breaker protection enabling the user to quickly reset the circuit rather than having to fumble about in the darkness trying to remove a blown fuse and then trying to find and install a new fuse, if indeed the user is so fortunate to carry a fresh fuse. One or more additional circuits can be provided to allow for the simultaneous use of two or more devices or for use as a backup circuit should the first circuit fail. Thus the user could use a second circuit backup light to change a bulb or otherwise repair the first circuit. Or failing to repair the first circuit, the backup light could be used to enable a miner or hunter to return to safety.

In addition, this invention provides a belt which is adjustable at the back so as to distribute the weight of the power packs to the sides and over the hips of the user thereby alleviating the aggravation of back problems that are present with the conventional suspension of the power pack weight at the center of the back and also enabling the user to wear such a power pack in a truck or car.

The circuit-protected power supply of this invention consists of a power pack, that is, one or more batteries or some other power source, wiring or other electrical connections to form a circuit connected to the power pack, a circuit breaker that forms a part of the circuit and is designed to protect the circuit, and a means for a user to carry or support the power pack on his or her person. The power pack and circuitry is connected to an electrical device such as an appliance as typified by a video tape recorder camera or a lamp such as a spot or flood light or a charging device for the power pack batteries. The circuitry may be provided with a device for conveniently connecting and disconnecting the appliance from the power pack circuit. Such connecting means may be a plug and jack. The power pack may contain additional circuits for connecting additional appliances to the power pack. For example, one of the circuits can be to a light which is worn on a hat as is typified by a miner's hat while the second circuit is connected to a hand-held spotlight. By using two circuits, one of the circuits can be provided with one or more resistors in series and a means for selecting the resistance to be placed in the circuit. Such a selection means can be a rotary switch. Such an arrangement allows a person to use one of the devices at full power while selecting varying amounts of resistance to restrict the amount of power available to the second device.

The power pack batteries are secured about the waist of a user by means of a belt to which the batteries are attached by means of a power pack housing. The circuit breaker, switch, resistors, jacks and other components are contained in a circuit breaker housing that is also fastened to the belt. The belt can be divided at the rear into two sections so that a means for varying the space between the sections at the back of the user can be provided. Such a space varying means can be one or more straps attached to the two sections of the belt and a means for adjusting the distance between the two sections of the belt. Such an adjusting means can be a belt buckle. By using a belt with a space adjusting means at the back, the weight of the power packs can be distributed to the sides and over the hips of the wearer thereby tending to alleviate aggravation to the lower back. Also in the position, the power pack can be comfortably worn while seated in a car, something which can not be done when the power pack is positioned on the back of the user.

The weight of the power pack can be further distributed on the shoulders of the wearer by attaching shoulder straps to the front and rear of the belt. The shoulder straps can be crossed at the back and secured to each other at the point where they cross. In addition, the straps can be provided with a means for adjusting their length. Typically, such an adjustment means is a ring attached to the belt whereby the strap passes through the ring and is secured back onto itself by means of a buckle.

Other objects and feature of the invention will be apparent and understood from the detailed description of the invention and the accompanying drawings which follow. The foregoing and other advantages of the invention will become apparent from the following disclosure in which a preferred embodiment of the invention is described in detail and illustrated in the accompanying drawings. It is contemplated that variations in procedures, structural features and arrangement of parts may appear to the person skilled in the art without departing from the scope or sacrificing any of the advantages of the invention.

BRIEF DESCRIPTION OF THE DRAWINGS

In the accompanying drawings, in which is shown one of the various possible illustrative embodiments of this invention, like reference characters identify the same or like parts.

DETAILED DESCRIPTION OF THE INVENTION AND BEST MODE FOR CARRYING OUT THE PREFERRED EMBODIMENT

Figure 1:
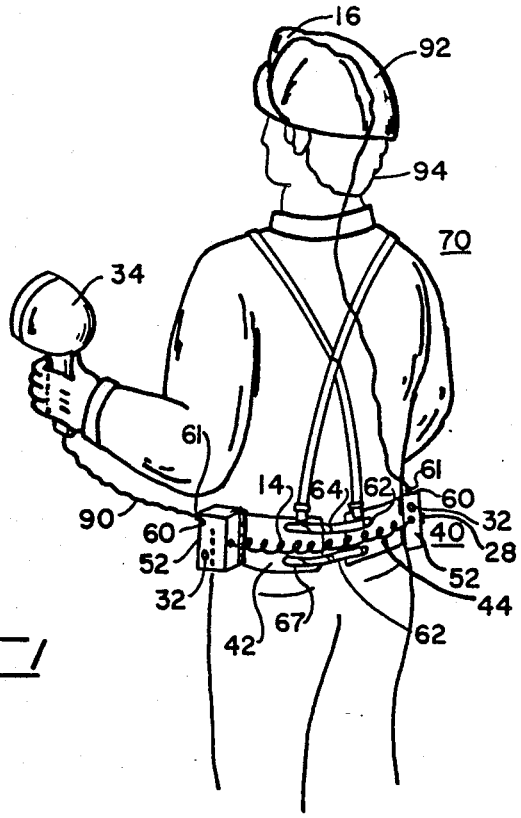
FIG. 1 is a view in perspective showing a person wearing the power pack of this invention and showing the power pack connected to a hand-held light and a hat mounted light.
Figure 3:
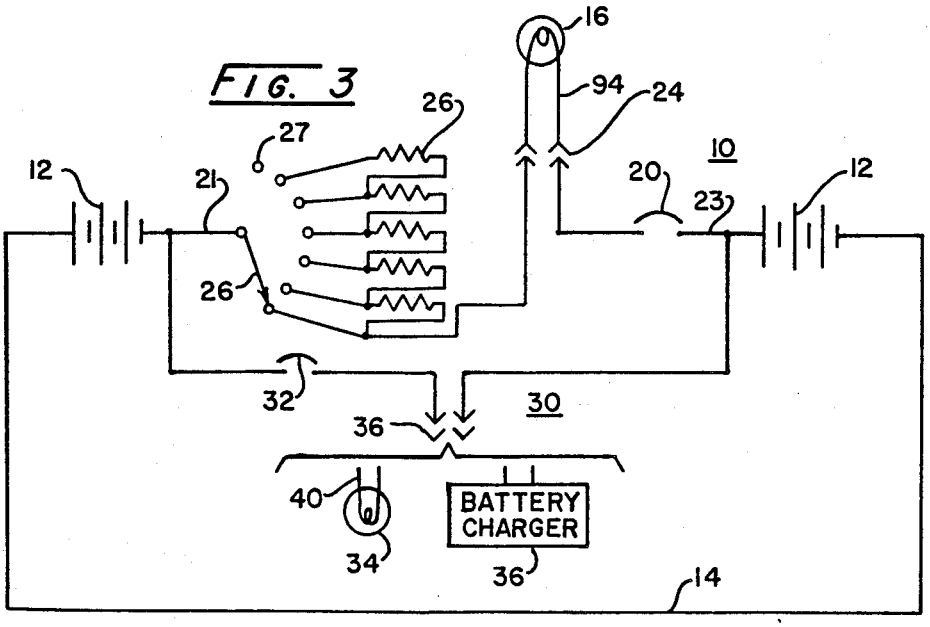
FIG. 3 is a schematic diagram of the electrical circuits of this invention.
Figure 2:
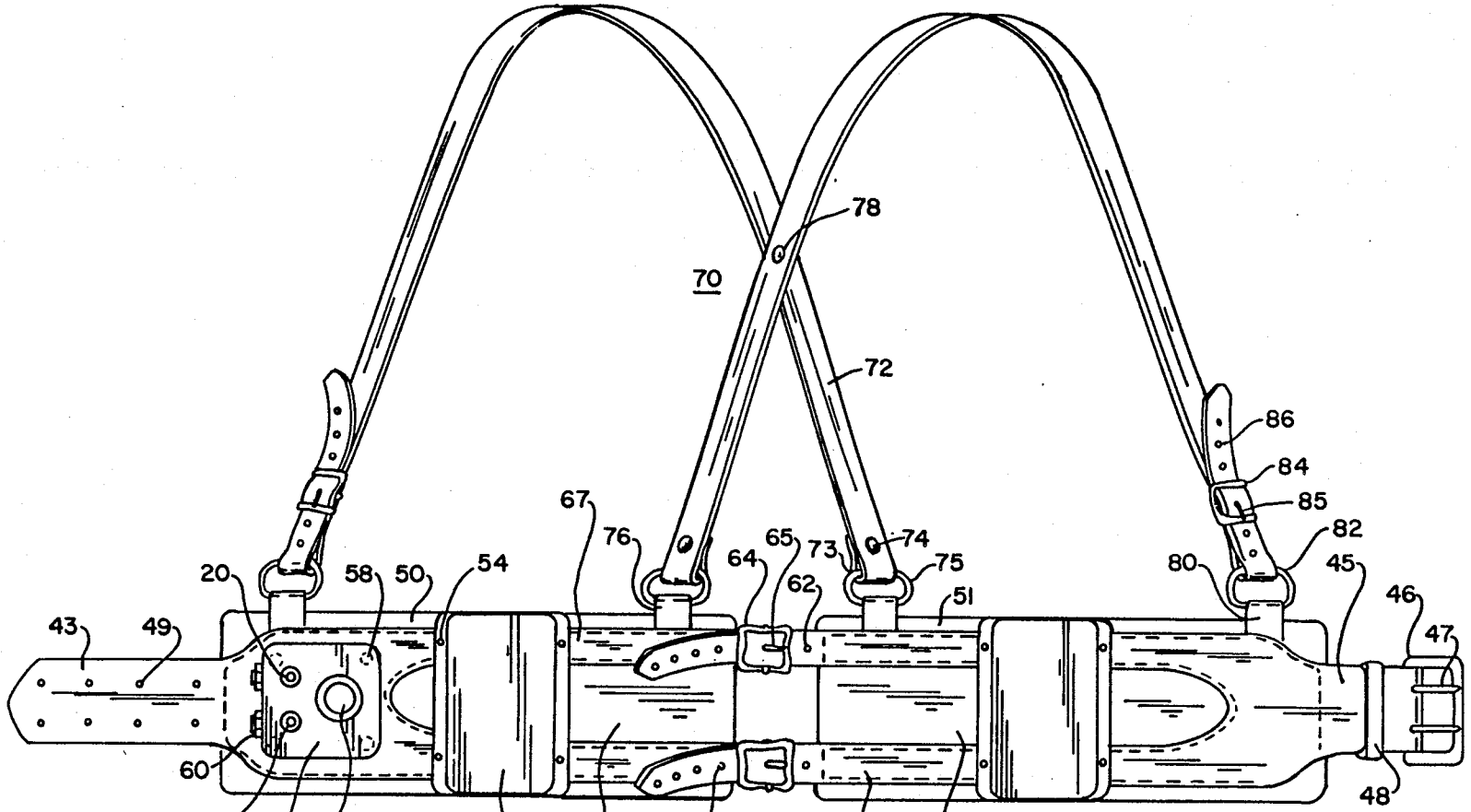
FIG. 2 is a view in perspective of the shoulder harness and belt with the power pack and control device attached.

In reference to the drawings there is shown and illustrated in FIGS. 1–3 an electrical assembly designated generally by reference character 10, a belt assembly designated generally by reference character 40, and a shoulder harness assembly designated generally by a reference character 70. As shown in FIG. 3, the electrical assembly 10 consists of two or more batteries 12 connected in series by electrical connector 14 that preferably is coiled to allow for adjustment in length (FIG. 1). Preferably each battery 12 is a six-volt battery which, when combined in series, gives a 12 volt system. The battery typically is a Model 14-6 Gel Cell manufactured by Yuhasa of Santa Fe Springs, Calif. or a comparable equivalent. Although it is possible to use the present invention with only one battery, two batteries are used to provide an even distribution of weight on the user's body. Other combinations of battery voltages and number of batteries may be used depending on the application for which the power pack is to be used.

To complete the circuit, an electrical device such as a lamp 16 or other electrical appliance and a circuit-breaker 20 are connected to the batteries 12 by connectors 21, 94 and 23. Means is provided for connecting and disconnecting the lamp 16 or other electrical device from the circuit by means of a connector 24 that consits of a plug 61 and jack 60 or other equivalent connecting device. A suitable plug is the model 3502 plug made by the Switchcraft of Chicago, Ill. The jack is a model 3501FP or FR jack also made by Switchcraft. The lamp 16 is a model 5100 or 5200 made by the Wheatlight Co. of Marlborough, Mass. or a model NHL 83 made by the Nite Lite Co., Clarksville Ak. The circuit breakers are 3 or 5 amp breakers, models W28XQIA-3 or W28XQIA-5, respectively, made by the Potter Broomfield, Colo. (Siemens) Franklin, Ky. The intensity of the lamp 16 can be varied by a set of resistors 26 placed in series. For the present application, 2 or 5 ohm, five watt wire wound resistors made by Phillips ECG, Inc. of Williamsport, Penna. are used to give a total resistance of about 10 to 15 ohms. The amount of resistance placed into the circuit is selected by the switch 26 which is a model MRX-108 made by NKK of America, Inc. of Scottsdale, Ariz. The switch 26 may also have an on-off position 27. A second circuit 30 can be connected to the batteries 12 and consists of a circuit-breaker 32 and an electrical device such a lamp 34 or a battery charger 36. The second lamp can be a 12V halogen or sealed beam hand spotlight such as a model H1285 made by the Nite Lite Co. A typical battery charger 36 to be used with this device is a ZX Power Supply made by Sinclair Company of the United Kingdom. The battery charger 36 can be of a type such as to plug into the cigarette lighter of a truck or car for on the road charging or it can be of a type for connection to a 110-volt outlet for charging when alternating current is available or both. A connector 37 similar to connector 24 can be used to connect and disconnect the electrical device from the circuit.

A wide variety of electrical components are known in the art that can be substituted for the above mentioned components. The above components are given to exemplify a preferred embodiment rather than in any way to limit this invention.

Shown in FIG. 2, the belt portion of this invention consists of two sections 42 and 44. Belt section 42 has a tongue section 43 joined to it and belt section 44 has a buckle section 45 are joined to it, the tongue section 43 and buckle section being joined together in the front of the user. The illustrated fastening device consists of a buckle 46 which has a double tongue 47 which is fitted interchangeably through openings 49 in the tongue section 43 of belt section 44. Holes 49 allow the belt to be adapted and tightened about the body of the wearer. The loop 48 at the end of the buckle section 45 of belt section 44 holds the tongue section 43 of belt section 42 in place when the belt is fastened. Many other belt fastening devices are known including Velcro-type fasteners, all of which are considered to be suitable fastening means for this invention.

The batteries 12 are attached to the belt sections 42 and 44 by means of a battery cover or casing 52. When the battery 12 is of a rechargeable type, the battery is placed inside the battery casing 52 and securely attached to the belt by means of a suitable fastening device such as rivets 54. A control box 56 is also suitably attached to the belt section 42 by suitable fastening means such as rivets 58. The control box 56 houses the resistors 26, the resistor selection switch 28, connecting jacks 60 and circuit breakers 20 and 32. As shown in FIG. 1, the control box 56 can be preferably eliminated by placing the connecting jacks 60, resistors 26, circuit breakers 32, and resistor selection switch 28 in battery casing 52.

Sections 42 and 44 of the belt are joined at the back by means of straps 62 which are affixed to belt section 44 and buckle straps 67 and buckles 64 which are affixed to belt section 42. The tongue 65 of the buckle 64 is fitted interchangeably through the openings 66 of strap 62. By using the strap 62 and buckle 64 to adjust the distance between belt sections 42 and 44, the position of the battery 12 which is found inside of battery cover 52 can be shifted so as to distribute the weight of the battery on the user's hips thereby providing additional support for the battery pack and alleviating undue strain upon the back of the user. As illustrated in FIG. 2, the belt sections 44 is formed from a piece of material that is distinct from the buckle end 45 and straps 62 which are formed from another piece of material and stitched to belt section 44. Similar considerations also apply to the buckles 64, the buckle straps 67, the tongue section 43, and belt section 42. Such a combination is preferable for the comfort, strength, and durability it provides. Many other combinations including a single piece construction are possible and considered to be equivalent for the purpose of this invention. For example, in FIG. 1, buckle straps 67 and straps 62 are joined to sections 42 and 44 respectively and are not integral with tongue section 43 and buckle section 45.

To further distribute the weight of the batteries on the person of the user, shoulder harness 70 is used. The shoulder harness 70 consists of two straps 72. A closed loop 73 is formed in one end of the strap 72 by means of a suitable fastening means such as a rivet 74. The closed loops 73 secure rings 75 which are secured to belt sections 42 and 44 by means of loops 76. The straps 72 cross on the back of the user and are held securely in place at the point of intersection by means of a rivet 78 or other suitable fastening means. Rings 82 are securely fastened to the front portion of belt sections 42 and 44 by means of loops 80. The straps 72 are adjustably fastened through rings 82 by means of a buckle 84 that is secured to strap 72 and embodying a tongue 85 which is fitted interchangeably through openings 86 in the end of strap 72. Of course there are many ways by which straps 72 can be secured to belt section 40. The means illustrated is that preferred by the inventor and in no way is meant to be a limiting feature of this invention.

FIG. 1 illustrates the invention as it might be worn by a typical user. The batteries inside of battery covers 52 are joined by coiled connector 14 and are positioned on the hips of the user by means of the adjustable strap 62, buckle 64 and buckle strap 67. The lamp 34 is connected to the batteries by means of connector cable 90, plug 61, and jack 60. Lamp 16 is secured to the front of hat 92 and connected to the power pack secured in housing 52 by means of connector cable 94, plug 61 and jack 60. Shoulder harness 70 further supports and distributes the weight of the batteries on the person of the user.

It is possible that changes in the configurations to other than those shown could be used without departing from the spirit and scope of this invention. That which is used is preferred and typical.

Without departing from the spirit of this invention, various means of fastening the various components together may be used. It is therefore understood that although the present invention has been specifically disclosed with the preferred embodiment and examples, modifications to the design concerning sizing and shape may be apparent to those skilled in the art, and such modifications and variations are considered to the within the scope of the invention and the appended claims.

I claim:

1. A circuit-protected power supply comprising:

a. a power pack;

b. a first circuit connected to said power pack;

c. a first circuit breaker incorporated in said first circuit;

d. a second circuit connected to said power pack;

e. a second circuit breaker incorporated in said second circuit; and f. a means for supporting said power pack on a user.

2. The power supply according to claim 1 further comprising one or more electrical devices connected to said first circuit.

3. The power supply according to claim 2 wherein said electrical device is in appliance.

4. The power supply according to claim 3 wherein said appliance is a lamp.

5. The power supply according to claim 2 wherein said electrical device is a means for charging said power pack.

6. The power supply according to claim 2 further comprising a means for connecting said device to said first circuit.

7. The power supply according to claim 6 where said connecting means is a plug and jack.

8. The power supply according to claim 1 further comprising one or more devices connected to said second circuit.

9. The power supply according to claim 8 further comprising a means for connecting said device to said second circuit.

10. The power supply according to claim 9 wherein said connecting means is a plug and jack.

11. The power supply according to claim 8 wherein said electrical device is a means for charging said power pack.

12. The power supply according to claim 8 wherein said device is an electrical appliance.

13. The power supply according to claim 12 wherein said electrical appliance is a lamp.

14. The power supply according to claim 2 further comprising a hat to which said electrical device is attached.

15. A power supply according to claim 4 further comprising a means for adding one or more resistors in series in said first circuit.

16. The power supply according to claim 15 wherein said resistor adding means is a switch.

17. The power supply according to claim 1 wherein said means for supporting said power pack on a user is a belt and means for securing said belt around said user's waist.

18. The power supply according to claim 17 further comprising one or more power pack housings and means for securing said housing to said belt.

19. The power supply according to claim 18 further comprising one or more housings for said circuit breaker and means for securing said housing to said belt.

20. The power supply according to claim 19 wherein said circuit breaker housing is said power pack housing.

21. A circuit-protected power supply comprising:

a. a power pack;

b. a circuit connected to said power pack;

c. a circuit breaker incorporated in said circuit;

d. a belt for supporting said power pack on a user comprising:

(1) a first section and a second section, (2) a means for securing said sections around said user, and (3) a means for varying the space between said first and second sections at the back of said user.

22. The power supply according to claim 21 with said space varying means comprising one or more straps attached to said first section and means for adjustably fastening said strap to said second section.

23. The power supply according to claim 21 further comprising two suspension shoulder straps with one said strap attached to the front of said first belt section and to the rear of said second belt section and the other said strap attached to the front of said second belt section and to the rear of said first belt section.

24. The power supply according to claim 23 wherein said suspension shoulder straps cross each other at the back of said user.

25. The power supply according to claim 24 wherein said suspension shoulder straps are secured to each other where they cross each other on the back of said user.

26. The power supply according to claim 23 with means for adjusting the length of said shoulder straps.

* * * * *